US005906373A

United States Patent [19]

Sanders

[11] Patent Number: 5,906,373

[45] Date of Patent: May 25, 1999

[54] WATER-TAG GAME PLAYED WITHIN A MAZE

[76] Inventor: Gary M. Sanders, 355 N. Lantana #720, Camarillo, Calif. 93010

[21] Appl. No.: 08/957,492

[22] Filed: Oct. 24, 1997

[51] Int. Cl.[6] ..... A63B 67/00; A63J 11/00

[52] U.S. Cl. ..... 273/349; 472/62; 472/92; 472/134

[58] Field of Search ..... 473/474; 273/349, 273/440, 440.1; 472/62, 92, 134

[56] References Cited

U.S. PATENT DOCUMENTS

| | | | |
|---|---|---|---|
| 4,040,622 | 8/1977 | Sinnott | 273/349 |
| 4,093,228 | 6/1978 | Pierce | 273/384 |
| 4,165,073 | 8/1979 | Kellerstrass | 273/349 |
| 4,197,679 | 4/1980 | Yamada et al. . | |
| 4,271,641 | 6/1981 | Kawaguchi | 52/2 |
| 4,363,483 | 12/1982 | Minami | 273/349 |
| 4,384,435 | 5/1983 | Polise et al. | 52/2 |
| 4,526,366 | 7/1985 | Kenoun | 273/454 |
| 4,556,391 | 12/1985 | Tardivel et al. | 446/7 |
| 4,718,661 | 1/1988 | Wolfe | 273/447 X |
| 4,743,030 | 5/1988 | Auer et al. | 273/349 |
| 4,819,389 | 4/1989 | Kihn | 52/2.21 |
| 5,219,317 | 6/1993 | Huffman | 472/62 |
| 5,261,873 | 11/1993 | Bremer et al. | 602/32 |
| 5,263,714 | 11/1993 | Rudell et al. | 273/138.1 |
| 5,411,269 | 5/1995 | Thomas | 273/349 |
| 5,435,569 | 7/1995 | Zilliox | 273/349 |

FOREIGN PATENT DOCUMENTS

| | | | |
|---|---|---|---|
| 101361 | 5/1925 | Austria | 472/62 |

*Primary Examiner*—William H. Grieb
*Attorney, Agent, or Firm*—Albert O. Cota

[57] ABSTRACT

A WATER TAG™ game (10) that consists of a maze structure (14) having an outer perimeter wall (16) enclosing a plurality of sections (20,22,24,26) and protrusions (40). An opening (36) admits players armed with water guns (12) into the maze structure (14). Once inside the players circulate among the sections (20,22,24,26) and the protrusions (40), firing their water guns (12) at each other. The maze structure (14) is inflated when the WATER TAG™ game is being played and can be deflated for storage and transportation.

14 Claims, 4 Drawing Sheets

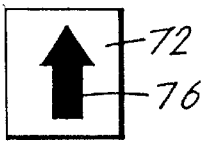
Fig.8
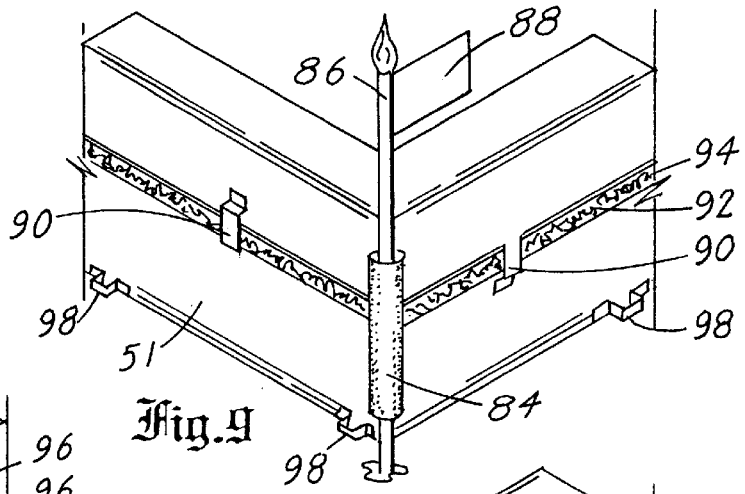
Fig.9
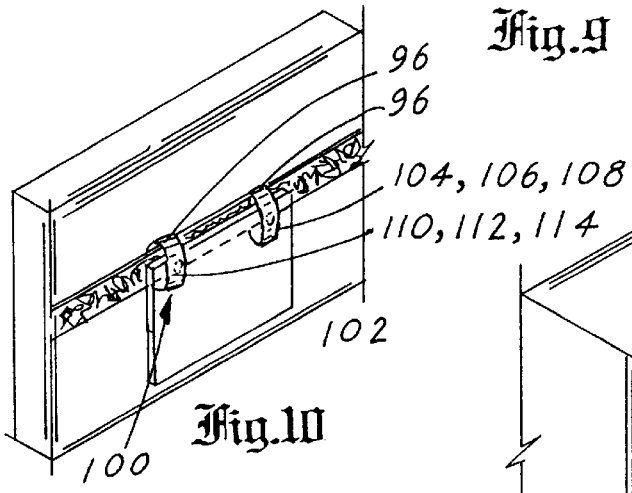
Fig.10
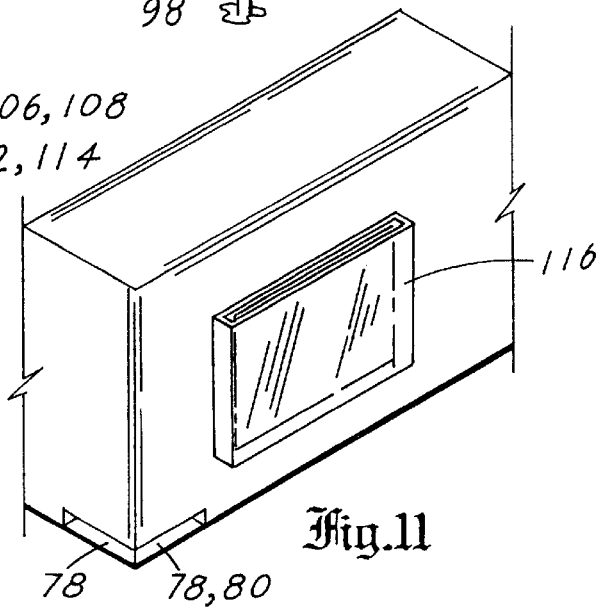
Fig.11
Fig.12
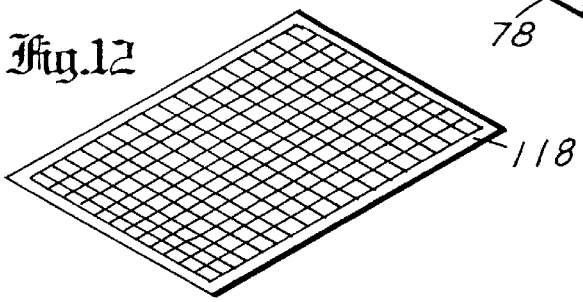
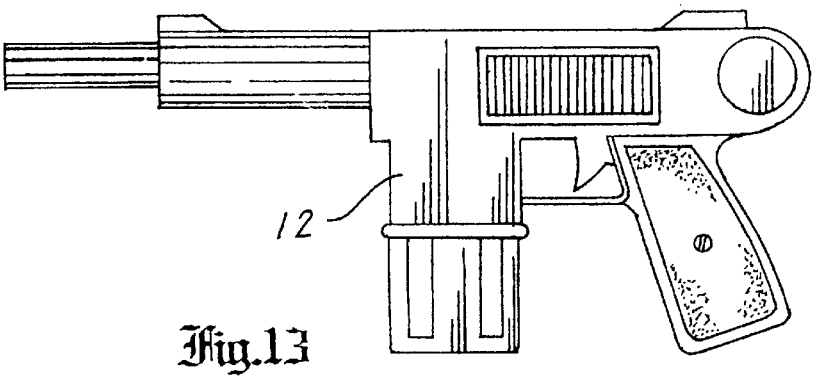
Fig.13

WATER-TAG GAME PLAYED WITHIN A MAZE

TECHNICAL FIELD

The invention pertains to the general field of water related games and more particularly to a game that is played within a make structure by individuals carrying water guns.

BACKGROUND ART

It has been suggested that man is aggressive by nature and thus drawn to compete in competitive games and sports. For thousands of years, man has competed in combative-type games, which allow a healthy release of hostile and aggressive tendencies. In order for combative-type games to be effective, they must accurately simulate actual combat reality. Most people have a concept of combat from what is seen on television or other media. Whenever an enemy has been shot, the event is registered by the enemy falling down or otherwise becoming disabled.

Water guns have long been implements of such combative-type games. These water guns allow individuals to shoot water at each other accurately beyond 50 feet, which allows a game such as the WATER TAG™ game disclosed herein to be played. In addition to the water guns, a specialized playing area equipped with wall or other barriers that allow players to hide behind greatly enhance the experience of playing a combative-type game.

A search of the prior art did not disclose any patents that read directly on the claims of the instant invention however, the following U.S. patents were considered related:

| PATENT NO. | INVENTOR | ISSUED |
|---|---|---|
| 5,411,269 | Thomas | May 2, 1995 |
| 4,819,389 | Kihn | Apr. 11, 1989 |
| 4,743,030 | Auer et al | May 10, 1988 |
| 4,363,483 | Minami | Dec. 14, 1982 |

The U.S. Pat. No. 5,411,269 patent discloses a water-gun target game and apparatus in which-a direct-current electrical water-presence detector, supported by or worn on an outer garment, is the target. A hit by a water jet from a water gun, initiates action by a direct electrical effect ordering responses by switching, sound or visual signaling, and scoring devices. A water-level sensor initiates a signal after a succession of hits or a strong continuous hit. An absorption option disposes received water, allowing repetitious operation. A tank for the water level sensor has a discharge stopper, which when removed, opens a power source circuit and inhibits any response. The object of the game is to project the jet stream of the water gun on to the target, making one or repetitious hits on the apparatus-bearer's bull's-eye.

The U.S. Pat. No. 4,819,389 patent discloses a typical inflatable tent structure consisting of a plurality of inflatable frames. The first plurality of inflatable frames define an interior region and include a plurality of interconnecting first frame elements which define an opening into the tents interior. The second inflatable frames, which are independently inflatable from the first frames, include a plurality of interconnecting second frame elements and are sized to fit entirely within the interior of the first inflatable frames. To complete the tent structure, a supporting fabric is secured over the first and second inflatable frames.

The U.S. Pat. No. 4,743,030 patent discloses a simulated combat game set in which the players are provided with toy water guns and each player wears a target. When a gun is fired by a player it shoots out a stream of Water, each player trying to hit a vulnerable site on the target worn by an opposing player and thereby strike him out. The vulnerable site on the target consists of a plaque or label having printed thereon a strike symbol or other hit indicator covered by a mask that conceals the indicator. The hit indicator is readable only when the mask is made wet and transparent by the water stream from the water gun.

The U.S. Pat. No. 4,363,483 patent discloses a game having a transparent housing filled with a liquid and a movable member. The member located in the liquid can be made competitive by utilizing a first and second circulating member each capable of ejecting a stream of liquid from a nozzle to move the movable member. The game incorporates a housing having two separate pivoting members. Each pivoting member is located in association with one of the nozzles and moves in response to impingement of liquid ejected from the nozzles. The ejected liquid impinges upon the surface of the pivoting members to both pivot the members and deflect the stream of liquid. The degree of pivoting and the amount of deflection are dependent on the force of ejection of the stream of liquid.

For background purposes and as indicative of the art to which the invention relates, reference may be made to the following remaining patents found in the search:

| PATENT NO. | INVENTOR | ISSUED |
|---|---|---|
| 4,040,622 | Sinnott | Aug. 9, 1977 |
| 4,093,228 | Pierce | June 6, 1978 |
| 4,165,073 | Kellerstrass | Aug. 21, 1979 |
| 4,197,679 | Yamada, et al | Apr. 15, 1980 |
| 4,271,641 | Kawaguchi | June 9, 1981 |
| 4,384,435 | Polise | May 24, 1983 |
| 4,526,366 | Kenoun | July 2, 1985 |
| 4,556,391 | Tardivel | Dec. 3, 1985 |
| 4,718,661 | Wolfe | Jan. 12, 1988 |
| 5,261,873 | Bremer et al | Nov. 16, 1993 |
| 5,263,714 | Rudell et al | Nov. 23, 1993 |
| 5,435,569 | Zilliox | July 25, 1995 |

DISCLOSURE OF THE INVENTION

The invention disclosed herein provides all the necessary elements to allow ether two opposing players or two opposing teams to safely engage each other in a combat-type water game known as WATER TAG™. The game is played within the confines of a maze structure, with each player "armed" with a water gun. The guns are capable of storing a quantity of water that is used as ammunition and are capable of "shooting" the water a substantial distance in order to strike an opposing player.

The maze structure consists of an outer perimeter wall which encloses a plurality of protrusions. These protrusions are arranged within the maze structure to provide the players with hiding places from which they might wait and ambush their opponents, the protrusions provide "cover" from a water stream being fired in a particular direction, and basically, the protrusions offer a safe alternative to simply running around outside and hiding behind trees or other common objects while playing WATER TAG™.

The WATER TAG™ game also offers almost unlimited game possibilities inasmuch as there are no rigid set rules. The players may create their own rules depending on the type of game they are playing or, they may even play the game with no rules. WATER TAG™ is very enjoyable for players who merely don their water guns and enter the maze structure shooting. Also, There is no need to possess any real degree of skill in order to play the game, although those persons who are "good shots" will probably do better, but even for those who are not "good shots", the game is still exciting, fast-paced and fun.

In view of the above disclosure, it is the primary object of the invention to provide a WATER TAG™ game that is fun for persons of all ages, sexes and skill levels. In addition to the primary object, it is also an object of the invention to provide a WATER TAG™ game that:

- offers an alternative environment to a normal outdoor setting,
- is capable of being played by persons with little or no experience with those types of games,
- can be easily stored and transported when the maze structure is deflated,
- can be constructed with or without a ceiling,
- is cost effective for persons who wish to purchase their own WATER TAG game or for those who would rent a game for a special event, and
- will provide years of enjoyment for children, youths and even adults.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 8 is a block diagram of an inlet port that incorporates a check Valve.

FIG. 9 is a partial perspective view of a maze corner that includes a horizontal loop into which is inserted a maze anchoring pole such as a flag pole; a plurality of vertical loops into which is inserted a band that adds rigidity to the maze and a plurality of pockets into which is inserted a weight which helps to anchor the maze; and a plurality of tie-down loops.

FIG. 10 is a partial perspective view of a maze section showing a pair of vertical loops attached to the band wherein to the loops is removably attached a sign.

FIG. 11 is a partial perspective view of a section to which is attached a translucent pocket into which is inserted a sign.

FIG. 12 is a perspective view of base that is attached around the lower perimeter of the maze structure.

FIG. 13 is an elevational view of a typical water gun.

BEST MODE FOR CARRYING OUT THE INVENTION

Figure 1:
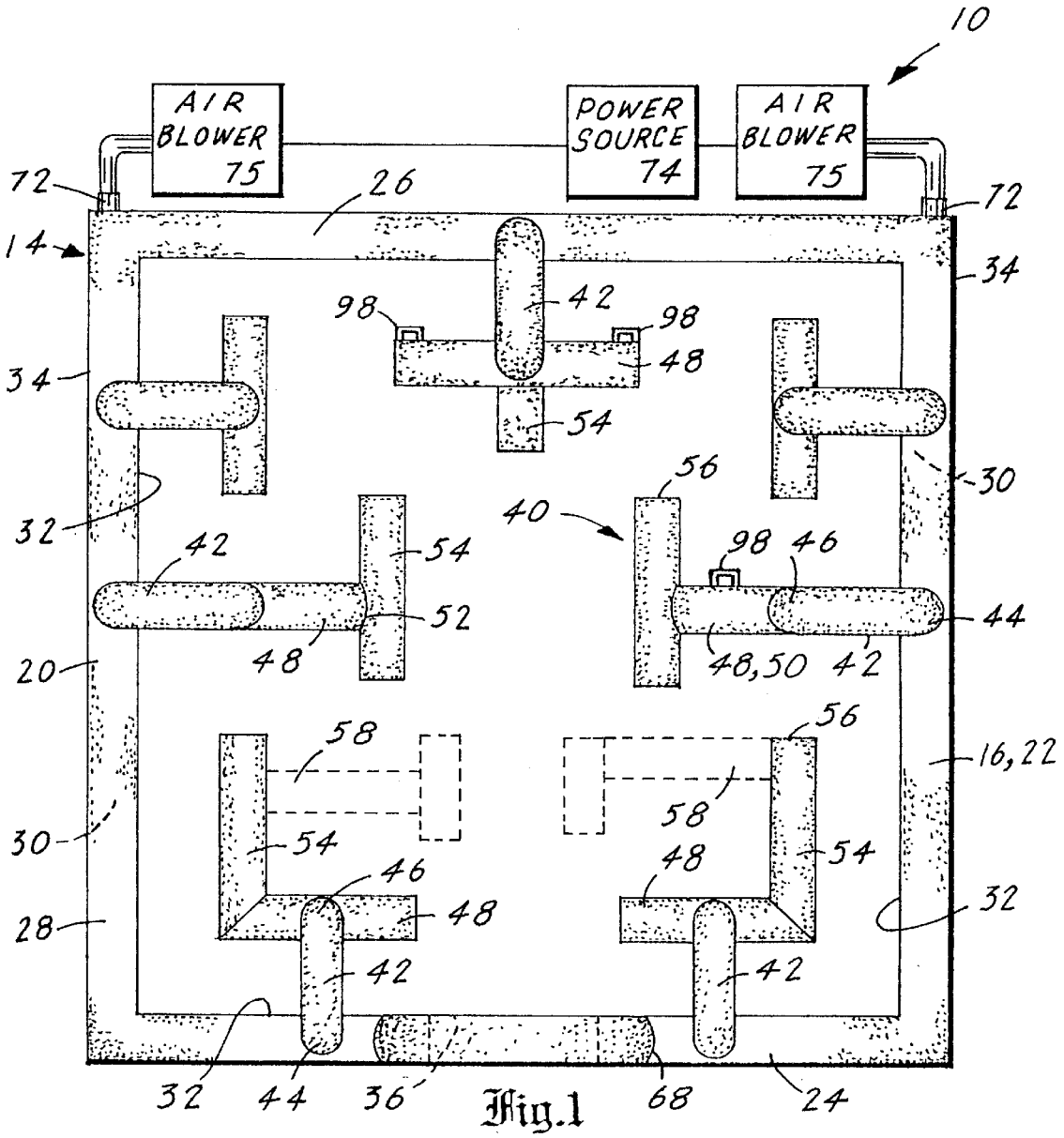
FIG. 1 is a top plan view of a typical rectangular maze structure wherein the game of WATER TAG™ is played by at least two players each having a water gun. The maze is shown with a power source that powers two air blowers connected respectively to two air inlet ports.

The best mode for carrying out the invention is presented in terms of a preferred embodiment for a WATER TAG™ game. The game consists of a combination of a water gun and a maze structure. In order to play the game, two or more players, each armed with a water gun, enter the maze structure. The design of the maze structure allows the players to move about and hide within the confines of the maze. As the game progresses the players will systematically be "shot" by each other and, depending on how the players have agreed to play the game, the game will eventually be won by the last player to not be shot. The game can also be played by teams of players as the maze structure is large enough to accommodate multiple players. The game is unique because it does not require stringent rules to be played; players can simply enter the maze structure and proceed to "shoot" at each other indiscriminately, with no set rules or guide lines.

The preferred embodiment of the WATER TAG™ game 10, as shown in FIGS. 1–13 is comprised of the following major elements: a water gun 12, a maze structure 14, an outer perimeter wall 16, protrusions 40, and an elevated entrance arch 66.

The WATER TAG™ game 10 is played by initially providing a water gun 12 to a first player and a second water gun 12 to a second player. The guns 12, as typically shown in FIG. 13, have means for storing a quantity of water—"ammunition", and for creating a stream of that water with sufficient force to reach an opposing player. Once both players, or each player if teams are involved, are armed with the water gun 12, the players enter the maze structure 14, as shown in FIGS. 1–5, which is where the WATER TAG™ game is played.

Figure 2:
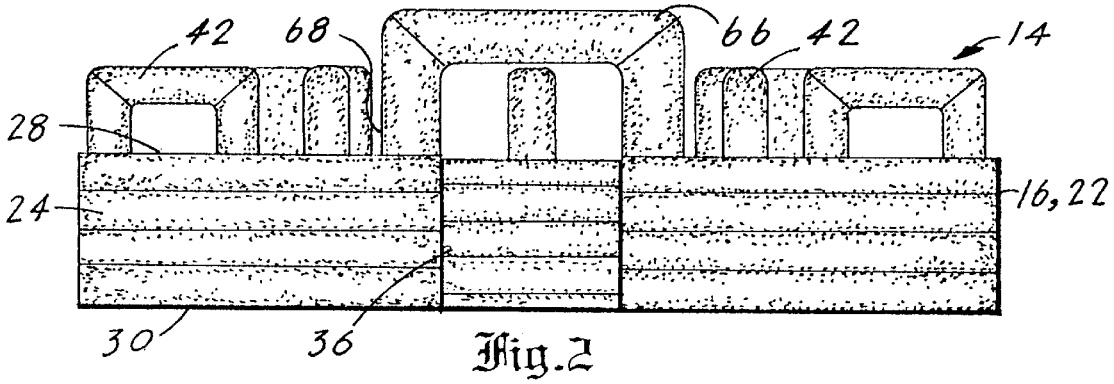
FIG. 2 is a front elevational view of the rectangular structure.
Figure 3:
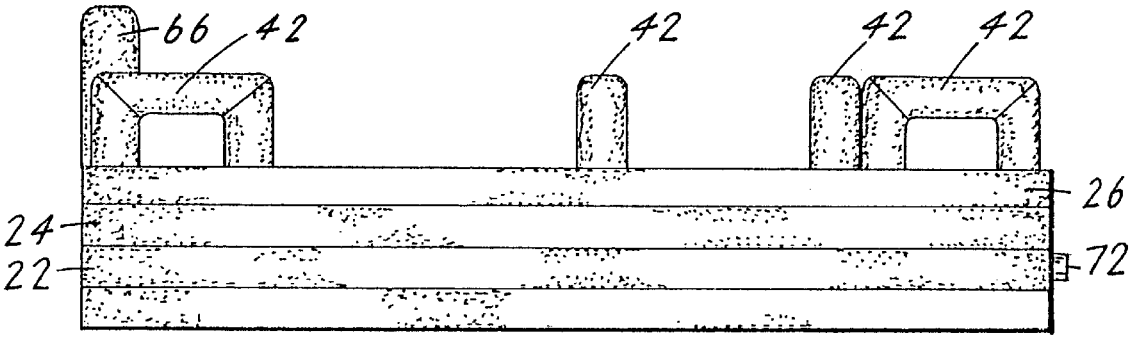
FIG. 3 is a side elevational view of the rectangular maze structure.
Figure 4:
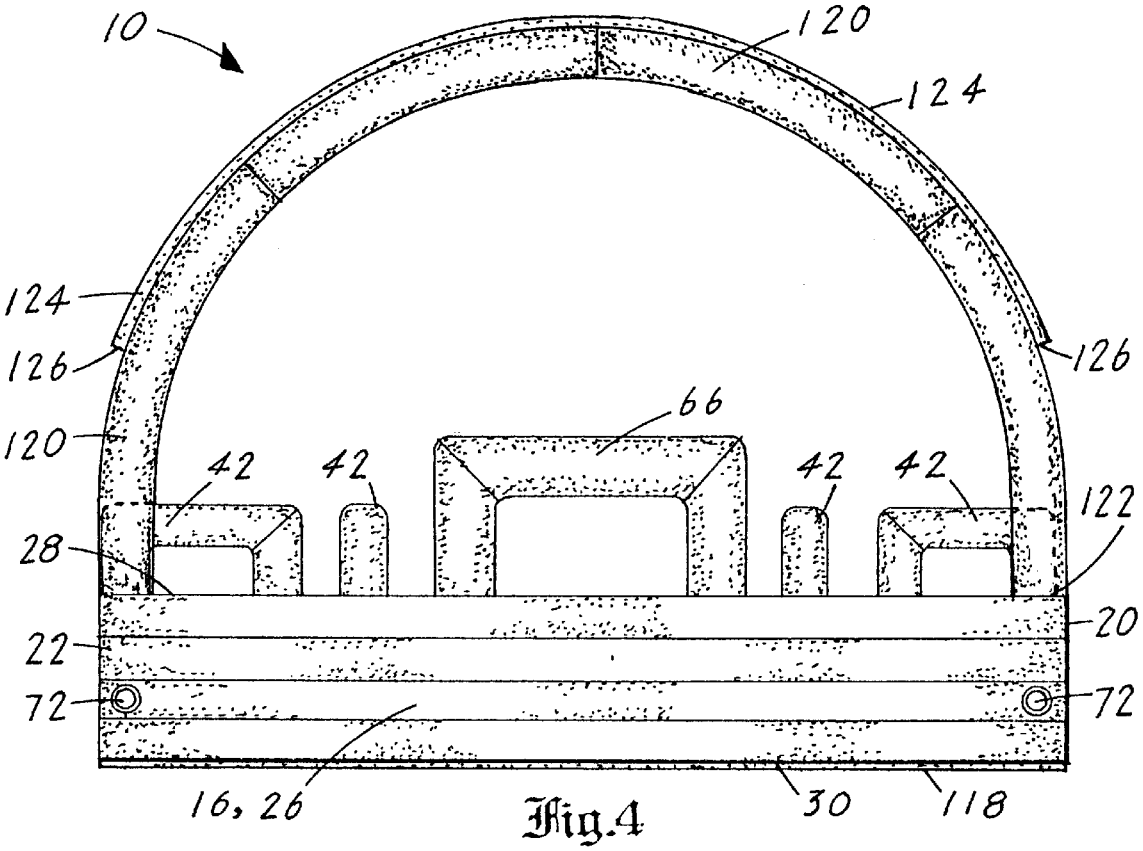
FIG. 4 is a rear elevational view of the rectangular structure that includes a single air inlet port and a plurality of elevated ceiling arches.
Figure 5:
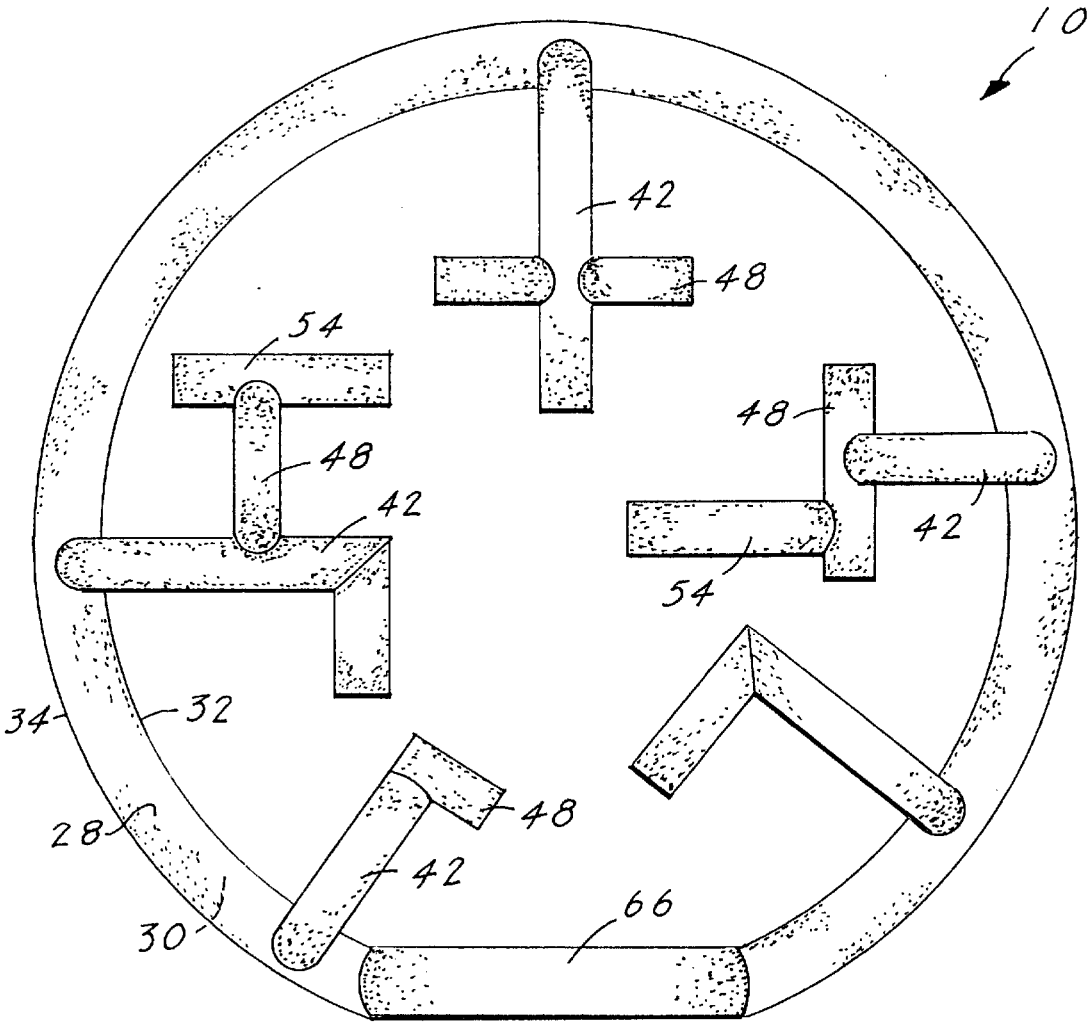
FIG. 5 is a top plan view of a typical circular maze structure.

The maze structure 14 is designed to be placed upon a substantially flat surface and is encompassed by the outer perimeter wall 16 which is substantially in a rectangular shape, as shown in FIGS. 1–4, but that may also be in a substantially circular shape, as shown in FIG. 5. A typical rectangular maze structure 14 has a perimeter having sides that each measure 25-feet (7.62 meters) in length and a height of 3.5 feet (1.07 meters). The protrusions also have a height of 3.5 feet (1.07 meters) and the elevated arch 66, located at the entrance of the maze as shown in FIG. 2, has a height that ranges between 6 and 8 feet (1.83 and 2.44 meters).

The outer perimeter wall 16 as best shown in FIG. 1, has a left section 20, a right section 22, a front section 24 and a rear section 26. Each of these respective sections 20,22,24, 26 also has an upper surface 28, a lower surface 30, an inner surface 32 and an outer surface 34. In order to allow a player to enter and exit the maze structure 14, at least one of the sections has an opening 36 in the outer perimeter wall 16 as best shown in FIG. 2. Located above the opening 36 is the elevated entrance arch 66, which has ends 68 that are attached to the upper surfaces 20 that border the opening 36 on the maze structure 14.

From the inner surface 32 of at least two sections extends inward the maze protrusions 40, as shown in FIGS. 1 and 5.

The maze protrusions 40 are comprised of a plurality of arched first protrusions 42 that have a first end 44 and a second end 46. The first end is attached to the upper surface 28 of the perimeter wall 16 and the second end 46 is attached to an upper surface 50 of a second protrusion 48 also having a lower surface 51. The second protrusion 48 has outer ends 52, with at least one of the outer ends 52 attached to a third protrusion 54 which also has outer ends 56, as best shown in FIG. 1.

Figure 6:
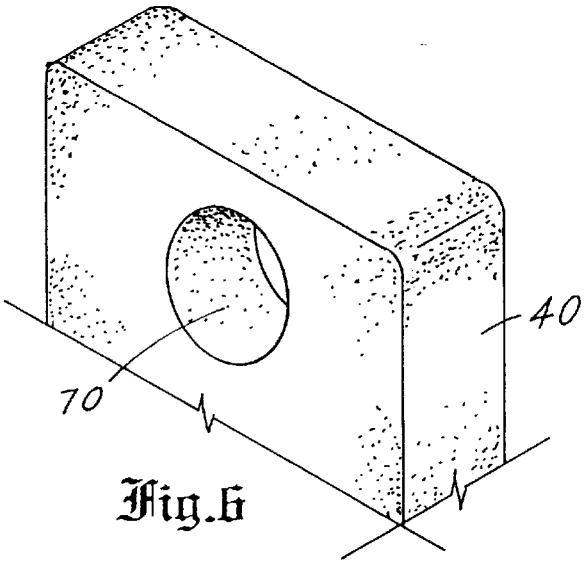
FIG. 6 is a perspective view of a section that includes a circular opening.

As shown in broken lines in FIG. 1, the third protrusion 54 may also have extending from at least one outer end 56 an optional fourth protrusion 58. By arranging a plurality of the protrusions within the confines of the perimeter wall 16, a unique and complex maze is created where the players may pursue, hide and ambush each other during the course of the WATER TAG™ game. To add further enjoyment to the game, selected sections may have a substantially centered opening 70 therethrough, as shown in FIG. 6. The opening 70 would allow a player to see through one of the sections in order to find a hidden opposing player or a player could "fire" his/her water gun 12 through the opening 70.

Figure 7:
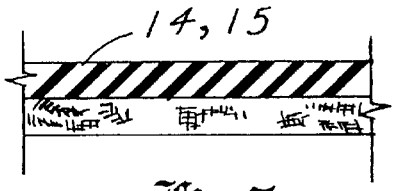
FIG. 7 is a cross sectional view of a maze constructed of a two-ply material.

The maze structure 14 is constructed of a polyvinyl chloride (PVC) having a weight that ranges between 10 to 20 ounces (284 to 567 grams). Alternatively, the maze structure can be constructed of a double-ply material, as shown in FIG. 7 that can consist of a canvas or vinyl outer material and a resilient i.e., rubber inner material. In either case, the maze structure 14 may have sewn seams or the seams may be heat sealed to provide a hermetic seal. In order to maintain the maze structure 14 in an upright, rigid configuration, the rear section 26 of the maze comprises an air inlet port 72 that accepts air from an air supplying means 74. The maze may include two air inlet ports 72, as shown in FIG. 1, or one air inlet port 72 as shown in FIG. 4. The air supplying means 74 consists of an air blower 75 operated by either a utility power source or a portable power generator.

Two air supplying methods are disclosed: in the first, the air supplying means 74 applies air in a continuous flow into the maze structure 14. In the second method, the air inlet port 72 incorporates a check valve 76 as shown in FIG. 8. The check valve seals the air inlet port 72 when the air supplying means 74 is removed after the maze structure 14 has been filed with air. In the second method, the maze structure has sealed seams to provide a hermetic seal.

To enhance the utility of the invention, a plurality of pockets 78 are located around the perimeter wall 16 near the lower surfaces 30 of the maze structure 14 as shown in FIG. 11. By inserting a weight 80 into each of one of the pockets 78, the maze structure 14 is anchored to the flat surface and will maintain its shape and size. The WATER TAG™ game 10 may further include a plurality of horizontal loops or a single elongated loop 84 as shown in FIG. 9, that is located around the perimeter wall 16, on the outer surfaces 34 of the sections 20,22,24,26 that comprise the maze structure 14. A staked pole, such as a flag pole 86, as also shown in FIG. 9, is inserted into the loops or loop 84 and is staked into the flat surface to maintain the maze structure 14 anchored to the surface. A plurality of vertical loops 90, as also shown in FIG. 9, may be located around the perimeter wall 16 centered near the outer surfaces 34 of the sections 20,22, 24,26. Into the vertical loops 90 is inserted a band 92 that has two ends 94. When the two band ends 94 are attached, the band 92 adds substantial rigidity to the maze structure 14. Located around the bands 92 may also be located a plurality of movable paired loops 96 as shown in FIG. 10. On the outward side of the bands is an attaching means 100 to which is attached a sign 102 having selectable indicia. The attaching means 100 may comprise a detent fastener 104, wherein a female detent 106 is attached to the movable paired loops 96 and a complimentary male detent 108 is attached to the sign 102. The attaching means 100 may also be comprised of a hook and loop fastener 110, wherein a hook section 112 is attached to the movable paired loops 96 and a complimentary loop section 114 is attached to the sign 102. Located adjacent the lower surface 30 of the perimeter wall 16 and the lower surface of the maze protrusions 40, as shown in FIGS. 1 and 9 respectively, is a tie-down loop 98. Into the loop 98 is inserted a stake that maintains the maze structure 14 in a stationary position.

A plurality of translucent pockets 116, as shown in FIG. 11, may also be attached to the outer surface 34 of the maze structure 14 by an attachment means. A sign that includes indicia may then be inserted into the translucent pockets. Any person viewing the outer surface 34 of the maze structure 14 could then see and/or read whatever the sign displays. This could be very useful to give game playing directions, precautions or any other information a person would want viewed by people looking at the maze structure.

The WATER TAG™ game 10 may further include a base 118, as shown in FIG. 12 that is attached, by an attachment means, around the perimeter wall 16 of the maze structure 14 to the lower surfaces 30 of the sections 20,22,24,26. The base may consist of a solid fabric, a perforated fabric or a string grid as shown in FIG. 12.

The WATER TAG™ game 10, as shown in FIG. 4, may also include a plurality of elevated ceiling arches 120 that may be square or circular as shown in FIG. 4. The arches 120 have ends 122 that are attached respectively to the upper surface 28 of the left and right sections 20,22 of the perimeter wall 16. Across the outer surface of the arches 120 is a cover 124 that is attached by an attachment means. The cover has ends 126 that terminate above the upper surface 28 of the perimeter wall 16 so that a space is provided that allows the players to see out and viewers to see inside the maze structure 14.

An added benefit of the WATER TAG™ game 10 is that the maze structure 14 is designed to be systematically folded to produce a folded maze structure that is easily stored and transported.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A water tag game played by at least two persons, said game comprising:

a) a water gun used by a first player and a second water gun used by a second player with said guns having means for storing a quantity of water and for creating a stream of water having sufficient force to reach an opposing player, and b) a maze structure where within the confines of said maze said water tag game is played, wherein said maze structure is designed to be placed upon a substantially flat surface and is comprised of an outer perimeter wall having a substantially rectangular shape and comprising a left section, a right section, a front section and a rear section, wherein each of said sections include an upper surface, a lower surface, an inner surface and an outer surface, with at least one of said sections having an opening dimensioned to allow a player to enter and exit said maze structure, and wherein from the inner surface of at least two sections extends inward a maze protrusion having ends, an upper surface and a lower surface, wherein said maze protrusions are comprised of a plurality of arched first protrusions having a first end attached to the upper surface of said outer perimeter wall and a second end that is attached to the upper surface of a second protrusion having outer ends, wherein to at least one outer end is attached a third protrusion also having outer ends, wherein said first, second and third protrusions establish the complexity of said maze structure.

2. The water tag game as specified in claim 1 wherein said third protrusion further has extending from at least one outer end a fourth protrusion.

3. The water tag game as specified in claim 2 further comprising an elevated entrance arch having ends that are attached to the upper surfaces that border the opening on said maze structure.

4. The water tag game as specified in claim 3 wherein selected sections further having a substantially centered opening therethrough.

5. A water tag game played by at least two persons, said game comprising:

a) a water gun used by a first player and a second water gun used by a second player, with said runs having means for storing a quantity of water and for creating a stream of water having sufficient force to reach an opposing player, and b) a maze structure where within the confines of said maze said water tag game is played, wherein said maze structure is designed to be placed upon a substantially flat surface and is comprised of an outer perimeter wall having a substantially rectangular shape and comprising a left section, a right section, a front section and a rear section, wherein each of said sections include an upper surface, a lower surface, an inner surface and an outer surface, with at least one of said sections having an opening dimensioned to allow a player to enter and exit said maze structure, and wherein from the inner surface of at least two sections extends inward a maze protrusion having ends, an upper surface and a lower surface, wherein said maze structure is constructed of a material that can be hermetically sealed to maintain a volume of air, and wherein the rear section of said maze further comprises an air inlet port that accepts air from an air supplying means, wherein said air maintains said maze structure in an upright rigid configuration.

6. The water tag game as specified in claim 5 wherein said air is applied in a continuous flow by said air supplying means which may consist of an air blower operated by either a utility power source or a portable power generator.

7. The water tag game as specified in claim 5 wherein said air inlet port includes a check valve that seals said air inlet port when said air supplying means is removed from said air inlet port after said maze structure is filled with air.

8. A water tag game played by at least two persons, said game comprising:

a) a water gun used by a first player and a second water gun used by a second player, with said guns having means for storing a quantity of water and for creating a stream of water having sufficient force to reach an opposing player, and b) a maze structure where within the confines of said maze said water tag came is played, wherein said maze structure is designed to be placed upon a substantially flat surface and is comprised of an outer perimeter wall having a substantially rectangular shape and comprising a left section, a right section, a front section and a rear section, wherein each of said sections include an upper surface, a lower surface, an inner surface and an outer surface, with at least one of said sections having an opening dimensioned to allow a player to enter and exit said maze structure, and wherein from the inner surface of at least two sections extends inward a maze protrusion having ends, an upper surface and a lower surface, wherein around the perimeter wall and near the lower surfaces of said maze structure is located a plurality of pockets, wherein into said pockets is inserted a weight that maintains said maze structure anchored to the flat surface.

9. The water tag game as specified in claim 8 further comprising a plurality of horizontal loops or an elongated loop located around the perimeter wall and on the outer surfaces of said sections that comprise said maze structure, wherein into said loops is inserted a flag pole that is staked into the flat surface to maintain said maze structure anchored to the flat surface.

10. The water tag game as specified in claim 9 further comprising a plurality of Vertical loops located around the perimeter wall and centered near the outer surfaces of said sections that comprise said maze structure, where into said vertical loops is inserted a band having two ends, wherein when the two ends of said band are attached, said band adds rigidity to said maze structure.

11. The water tag game as specified in claim 10 further comprising a plurality of movable paired loops located around said band, with sand bands having on their outward side an attaching means, wherein to the attaching means of each said pair of loops is attached a sign having selectable indicia.

12. The water tag game as specified in claim 11 further comprising a plurality of tie-down loops located adjacent the lower surface of said perimeter wall and said maze protrusions, wherein into said tie-down loops is inserted a stake that maintains said maze structure in a stationary position.

13. The water tag game as specified in claim 8 further comprising:

a) a plurality of elevated ceiling arches having an upper surface and ends that are attached respectively to the upper surface of the left and right sections of said perimeter wall, and b) a cover that is attached, by an attachment means to the upper surface of said elevated ceiling arches, wherein said cover has ends that terminate above the upper surface of said perimeter wall so that a space is provided which allows the players to see out and viewers to see inside the maze structure.

14. The water tag game as specified in claim 13 further comprising a plurality of translucent pockets attached to the outer surface of said maze structure by an attachment means wherein into said translucent pockets is inserted a sign that includes indicia.

* * * * *